US010087539B2

(12) United States Patent
Powell, IV et al.

(10) Patent No.: US 10,087,539 B2
(45) Date of Patent: Oct. 2, 2018

(54) LIQUID METAL ELECTRODES FOR GAS SEPARATION

(71) Applicant: Infinium, Inc., Natick, MA (US)

(72) Inventors: Adam Clayton Powell, IV, Newton, MA (US); John Strauss, Rindge, NH (US); Robert Steve Tucker, New York, NY (US); Jason Brodie Voellinger, Allston, MA (US)

(73) Assignee: Infinium, Inc., Natick, MA (US)

( * ) Notice: Subject to any disclaimer, the term of this patent is extended or adjusted under 35 U.S.C. 154(b) by 134 days.

(21) Appl. No.: 14/897,724

(22) PCT Filed: Jun. 12, 2014

(86) PCT No.: PCT/US2014/042163
§ 371 (c)(1),
(2) Date: Dec. 11, 2015

(87) PCT Pub. No.: WO2014/201274
PCT Pub. Date: Dec. 18, 2014

(65) Prior Publication Data

US 2016/0145754 A1 May 26, 2016

Related U.S. Application Data

(60) Provisional application No. 61/834,180, filed on Jun. 12, 2013.

(51) Int. Cl.
*C25C 7/02* (2006.01)
*C25C 7/00* (2006.01)
(Continued)

(52) U.S. Cl.
CPC ..... *C25C 7/005* (2013.01); *C25B 1/02* (2013.01); *C25B 9/14* (2013.01); *C25C 3/00* (2013.01);
(Continued)

(58) Field of Classification Search
USPC ..... 204/260, 272
See application file for complete search history.

(56) References Cited

U.S. PATENT DOCUMENTS 400,664 A 4/1889 Hall
3,138,490 A 6/1964 Carter et al.
(Continued)

FOREIGN PATENT DOCUMENTS

WO WO-2013/028798 A1 2/2013

OTHER PUBLICATIONS

Kan et al, Challenges and prospects of anodes for solid oxide fuel cells (SOFCs), Ionics, vol. 21, No. 2, Feb. 2015, pp. 301-318 (Year: 2015).*

(Continued)

*Primary Examiner* — Harry D Wilkins, III
(74) *Attorney, Agent, or Firm* — Wilmer Cutler Pickering Hale and Dorr LLP

(57) ABSTRACT

Methods separates a gas comprising providing a first electrode in ion-conducting contact with an electrolyte, providing a second electrode in ion-conducting contact with the electrolyte, wherein the second electrode comprises a liquid metal, providing a displacing material comprising a first surface in contact with the second electrode and a second surface exposed to an environment outside the second electrode, wherein said material permits flow of gas and impedes flow of liquid metal, and establishing a potential between the first and second electrodes, whereby gas flows toward the liquid metal. Other aspects include methods and apparatuses comprising electrodes, electrolytes and displacing materials.

17 Claims, 4 Drawing Sheets

(51) Int. Cl.

| | |
|---|---|
| ***C25C 3/00*** | (2006.01) |
| ***C25B 1/02*** | (2006.01) |
| ***C25B 9/14*** | (2006.01) |
| *C25C 3/04* | (2006.01) |
| *C25C 3/02* | (2006.01) |

(52) U.S. Cl.
CPC ..... *C25C 7/025* (2013.01); *C25C 3/02* (2013.01); *C25C 3/04* (2013.01)

(56) References Cited

U.S. PATENT DOCUMENTS

| | | | | |
|---|---|---|---|---|
| 3,262,868 | A * | 7/1966 | Juda | B01D 61/44 204/265 |
| 3,578,580 | A * | 5/1971 | Schmidt-Hatting | C25C 3/06 204/243.1 |
| 4,601,802 | A * | 7/1986 | Grimes | C25F 7/00 204/212 |
| 5,562,754 | A | 10/1996 | Kang et al. | |
| 5,567,286 | A | 10/1996 | Pal et al. | |
| 5,837,125 | A | 11/1998 | Prasad et al. | |
| 5,976,345 | A | 11/1999 | Pal et al. | |
| 6,299,742 | B1 | 10/2001 | Pal et al. | |
| 6,623,714 | B2 | 9/2003 | Shreiber et al. | |
| 7,118,612 | B2 | 10/2006 | Shreiber et al. | |
| 7,588,626 | B2 | 9/2009 | Gopalan et al. | |
| 7,745,064 | B2 * | 6/2010 | Blake | H01M 4/86 429/443 |
| 7,943,270 | B2 | 5/2011 | Blake et al. | |
| 8,658,007 | B2 | 2/2014 | Pal | |
| 9,206,516 | B2 * | 12/2015 | Powell | C25C 1/00 |
| 2003/0143440 | A1 | 7/2003 | Tao et al. | |
| 2007/0269688 | A1 | 11/2007 | Lipilin et al. | |
| 2009/0071841 | A1 | 3/2009 | Pal et al. | |
| 2009/0166214 | A1 | 7/2009 | Tao et al. | |
| 2010/0266907 | A1 | 10/2010 | Yazami | |
| 2010/0276297 | A1 * | 11/2010 | Powell, IV | C25B 1/006 205/350 |
| 2011/0079517 | A1 | 4/2011 | Powell, IV et al. | |
| 2013/0026032 | A1 | 1/2013 | Pal et al. | |
| 2013/0143139 | A1 | 6/2013 | Tao et al. | |
| 2013/0186769 | A1 * | 7/2013 | Powell | C25C 1/00 205/343 |
| 2013/0192998 | A1 | 8/2013 | Powell, IV et al. | |

OTHER PUBLICATIONS

Eustathopoulos, N., et al., "The oxygen-wetting transition in metal/oxide systems," Mater. Sci. Eng. A. Struct. Mater. Prop. Microstruct. Process, vol. A300, Issue 1-2, pp. 34-40 (Feb. 28, 2001).

International Search Report and Written Opinion issued by the U.S. Patent and Trademark Office as International Searching Authority for International Application No. PCT/US14/42163 dated Oct. 16, 2014 (9 pages).

Karakaya, I. and Thompson, W. T., "The Ag-O (Silver-Oxygen) System," Journal of Phase Equilibria, vol. 13, Issue 2, pp. 137-142 (Apr. 1992).

Terzieffa, P., et al., "Electronic properties of dilute Cr in liquid silver," Journal of Alloys and Compounds, vol. 274, Issue 1-2, pp. 148-152 (Jun. 1998).

* cited by examiner

LIQUID METAL ELECTRODES FOR GAS SEPARATION

CROSS-REFERENCE TO RELATED APPLICATIONS

This application is a U.S. National Stage application under 35 U.S.C. § 371 of International Patent Application No. PCT/US14/42163, filed Jun. 12, 2014, which claims the benefit of and priority to U.S. provisional patent application Ser. No. 61/834,180, filed Jun. 12, 2013, entitled "Low-Metal Inert Anode for High-Temperature Oxygen Separation", the disclosure of which is hereby incorporated by reference in its entirety for all purposes.

All publications, patent applications, patents, and other references mentioned herein are incorporated by reference in their entirety. The patent and scientific literature referred to herein establishes knowledge that is available to those skilled in the art. The issued patents, applications, and other publications that are cited herein are hereby incorporated by reference to the same extent as if each was specifically and individually indicated to be incorporated by reference. In the case of inconsistencies, the present disclosure will prevail.

GOVERNMENT SUPPORT

This invention was made with government support under Grant No. 1026639 awarded by the National Science Foundation and Award No. DE-EE0005547 awarded by the Department of Energy. The government has certain rights in the invention.

FIELD OF THE INVENTION

The invention relates to electrodes for gas separation and generation.

BACKGROUND OF THE INVENTION

The Hall-Héroult cell revolutionized aluminum production in 1886 (U.S. Pat. No. 400,664; herein incorporated by reference in its entirety) by reducing aluminum oxide dissolved in a molten salt, with a consumable carbon anode that reacts with the oxygen to form carbon dioxide. This type of electrolytic cell has been used more recently to produce other metals such as neodymium. Following invention of the Hall-Héroult cell, the aluminum industry and others have been seeking a material to serve as an inert anode in place of the carbon anode. The demands on such a material are very high: it must conduct electrons well, at high temperature, in direct contact with both oxygen and molten salt, both of which are at unit activity, and must not impede oxygen gas mass transfer. Most metals oxidize and/or evaporate in oxygen at high temperatures; most oxide conductors dissolve in the molten salt; and most other materials do not conduct electricity well enough for this application.

Use of a solid electrolyte, such as stabilized zirconia, between the molten salt and anode removes the anode requirement of chemical stability in contact with a molten salt. For reactive metals such as aluminum, magnesium, calcium and rare earth metals, the solid electrolyte improves current efficiency considerably by presenting a solid barrier between the metal produced at the cathode and oxidizing gases produced at the anode, preventing back-reaction (see, for example, U.S. Pat. Nos. 5,976,345 and 6,299,742; each herein incorporated by reference in its entirety). The process comprises a solid oxygen ion-conducting membrane (SOM) typically consisting of zirconia stabilized by yttria (YSZ) or other low valence oxide-stabilized zirconia, for example, magnesia- or calcia-stabilized zirconia (MSZ or CSZ, respectively) in contact with the molten salt electrolyte bath in which the metal oxide is dissolved, an anode in ion-conducting contact with the solid oxygen ion-conducting membrane, and a power supply for establishing a potential between the cathode and anode. The SOM process runs at high temperature, typically 1000-1300° C., in order to maintain high ionic conductivity of the SOM. However, an inert anode must still have high conductivity and stability in oxygen at high temperature.

Liquid silver and gold satisfy all of these requirements, and zirconia can serve as a container for such a liquid metal anode. This gives a minimum operating temperature of the silver-oxygen eutectic at 939° C. (*J. Phase Equillibria* 1992, 13(2), 137-142; hereby incorporated by reference herein in its entirety). Their alloys with other electronegative elements including, but not limited to, copper, tin, lead, bismuth, or combinations thereof can also satisfy these requirements at lower cost and lower temperature. However, silver and gold are very expensive, and any significant dilution with these alloying elements risks their oxidation. Even partial oxidation of the alloying elements would raise the alloy's solidus and liquidus temperatures and present a barrier to oxygen transport, as well as a possible corrodant to the zirconia electrolyte.

Thus, there remains a need for more stable and inexpensive anode systems to stabilize anodes in an oxygen generating environment. This invention addresses these needs.

BRIEF SUMMARY OF THE INVENTION

In one aspect of the invention, a method for separating a gas is provided comprising:

(a) providing a first electrode in ion-conducting contact with an electrolyte;

(b) providing a second electrode in ion-conducting contact with the electrolyte, wherein the second electrode comprises a liquid metal;

(c) providing a displacing material comprising a first surface in contact with the second electrode and a second surface exposed to an environment outside the second electrode, wherein said material permits flow of gas and impedes the flow of liquid metal; and (d) establishing a potential between the first and second electrodes, whereby gas flows toward the liquid metal.

In some embodiments, the first electrode is an anode. In some embodiments, the electrolyte comprises a dissolved oxide. In some embodiments, the second electrode is a liquid metal cathode in contact with a solid oxygen ion-conducting electrolyte. In some embodiments, establishing a potential generates oxygen dissolved in the liquid cathode, at least a portion of which diffuses through the displacing material to the environment. In some embodiments, the potential comprises a chemical potential. In some embodiments, a chemical potential is established by providing a fuel at the first electrode and providing an oxidizing gas at the second surface of the displacing material. In some embodiments, the gas comprises oxygen. In some embodiments, the methods further comprise providing a current collector in electron-conducting contact with the second electrode. In some embodiments, potential is established between the first electrode and the current collector.

In another aspect of the invention, a method for separating oxygen is provided comprising:

(a) providing a cathode in ion-conducting contact with a molten electrolyte, the electrolyte comprising a dissolved oxide;

(b) providing a liquid metal anode in electron-conducting contact with a solid oxygen ion-conducting electrolyte, wherein the solid oxygen ion-conducting electrolyte is in ion-conducting contact with the molten electrolyte;

(c) providing a displacing material comprising a first surface in contact with the liquid metal anode and a second surface exposed to an environment outside the liquid anode, wherein said material permits flow of gas and impedes the flow of liquid metal; and (d) establishing a potential between the cathode and the liquid metal anode, thereby generating oxygen dissolved in the liquid anode, at least a portion of which diffuses through the displacing material to the environment.

In some embodiments, the first electrode is a cathode. In some embodiments, the electrolyte comprises a dissolved oxide. In some embodiments, the second electrode is a liquid metal anode in contact with a solid oxygen ion-conducting electrolyte. In some embodiments, establishing a potential generates oxygen dissolved in the liquid anode, at least a portion of which diffuses through the displacing material to the environment. In some embodiments, the methods further comprise providing a current collector in electron-conducting contact with the anode.

In another aspect, an apparatus is provided comprising:

(a) a cathode in ion-conducting contact with a molten electrolyte;

(b) a solid oxygen ion-conducting electrolyte in ion-conducting contact with the molten electrolyte;

(c) a liquid metal anode disposed within the solid oxygen ion-conducting electrolyte;

(d) a displacing material comprising a first surface in contact with the liquid metal anode and a second surface exposed to an environment outside of the liquid metal anode, wherein said material permits flow of gas and impedes the flow of liquid metal; and (e) a power supply for establishing a potential between the cathode and the anode.

In some embodiments, the apparatus further comprises a current collector in electronic contact with the liquid metal anode and a potential is established between the cathode and the current collector.

In another aspect, an apparatus for separating oxygen is provided comprising:

(a) a liquid metal anode disposed within a solid oxygen ion-conducting electrolyte; and (b) a displacing material comprising a first surface in contact with the liquid metal anode, wherein said material permits flow of gas and impedes the flow of liquid metal.

In some embodiments, the apparatus further comprises a cathode in ion-conducting contact with an electrolyte. In some embodiments, the apparatus further comprises a current collector. In some embodiments, the apparatus further comprises a power supply for establishing a potential between the cathode and the anode.

In another aspect, a method for separating a gas is provided comprising:

(a) providing a first electrode in ion-conducting contact with an electrolyte;

(b) providing a second electrode in ion-conducting contact with the electrolyte, wherein the second electrode comprises a liquid metal;

(c) providing a displacing material comprising a first surface in contact with the liquid metal and a second surface exposed to gas, wherein said material permits flow of gas and impedes the flow of liquid metal; and (d) establishing a potential between the first and second electrodes, wherein gas flows toward the liquid metal.

In another aspect, a method for generating electricity is provided comprising, (a) providing a first electrode in ion-conducting contact with an electrolyte;

(b) providing a second electrode in ion-conducting contact with the electrolyte, wherein the second electrode comprises a liquid metal;

(c) providing a displacing material comprising a first surface in contact with the second electrode and a second surface exposed to an environment outside the second electrode, wherein said material permits flow of gas and impedes the flow of liquid metal; and (d) providing a fuel at the first electrode and an oxidizing gas at the second surface of the displacing material, thereby establishing a chemical potential between the first and second electrodes.

In some embodiments, the gas comprises oxygen, chlorine or a cation gas. In some embodiments, the gas comprises chlorine or a cation gas. In some embodiments, the cation gas comprises sodium. In some embodiments, the gas comprises oxygen.

In some embodiments, the first surface of the displacing material comprises protrusions. In some embodiments, the protrusions displace at least a portion of the second electrode. In some embodiments, the protrusions displace at least a portion of the liquid anode. In some embodiments, the protrusions comprise bumps, ridges, rings or spirals.

In some embodiments, the displacing material comprises a plurality of displacing solids. In some embodiments, conduits are introduced through the displacing material. In some embodiments, the displacing material comprises a porous oxide or an oxygen transport membrane. In some embodiments, the oxygen transport membrane comprises a mixed ionic-electronic conductor. In some embodiments, the porous oxide comprises alumina, zirconia, magnesia, ceria, titania, aluminum titanate or aluminum zirconate. In some embodiments, the liquid metal does not enter the pores of the displacing material. In some embodiments, the displacing material comprises a two-phase liquid solid material. In some embodiments, the liquid phase is immiscible with the liquid metal anode. In some embodiments, the liquid phase comprises lead oxide, tellurium oxide or bismuth oxide.

In some embodiments, the liquid metal is oxygen stable. In some embodiments, the liquid metal wets the surface of the solid electrolyte. In some embodiments, the second electrode comprises silver, gold, or alloys thereof. In some embodiments, the liquid metal anode comprises silver, gold, or alloys thereof. In some embodiments, the second electrode alloy further comprises copper, tin, lead, or bismuth. In some embodiments, the liquid metal anode alloy further comprises copper, tin, lead, or bismuth. In some embodiments, the second electrode comprises silver. In some embodiments, the liquid metal anode comprises silver.

In some embodiments, gaseous ions pass from the second electrode toward the displacing material. In some embodiments, gaseous ions pass from the second electrode through the displacing material. In some embodiments, oxygen ions pass from the anode toward the displacing material. In some embodiments, oxygen ions pass from the anode through the displacing material.

In some embodiments, a fuel source is exposed to the liquid metal. In some embodiments, the fuel source comprises hydrocarbon, hydrogen, carbon monoxide or carbon.

In some embodiments, at least a portion of the fuel source diffuses into the displacing material. In some embodiments, fuel source is oxidized to form water, carbon monoxide or carbon dioxide.

BRIEF DESCRIPTION OF THE DRAWINGS

The following figures are illustrative only and are not intended to be limiting.

DETAILED DESCRIPTION

Definitions

As used herein and in the appended claims, the singular forms "a," "an," and "the" include plural references unless the content clearly dictates otherwise.

The term "about" is used herein to mean approximately, in the region of, roughly, or around. When the term "about" is used in conjunction with a numerical range, it modifies that range by extending the boundaries above and below the numerical values set forth. The term "about" is used herein to modify a numerical value above and below the stated value by a variance of 20%.

Figure 1:
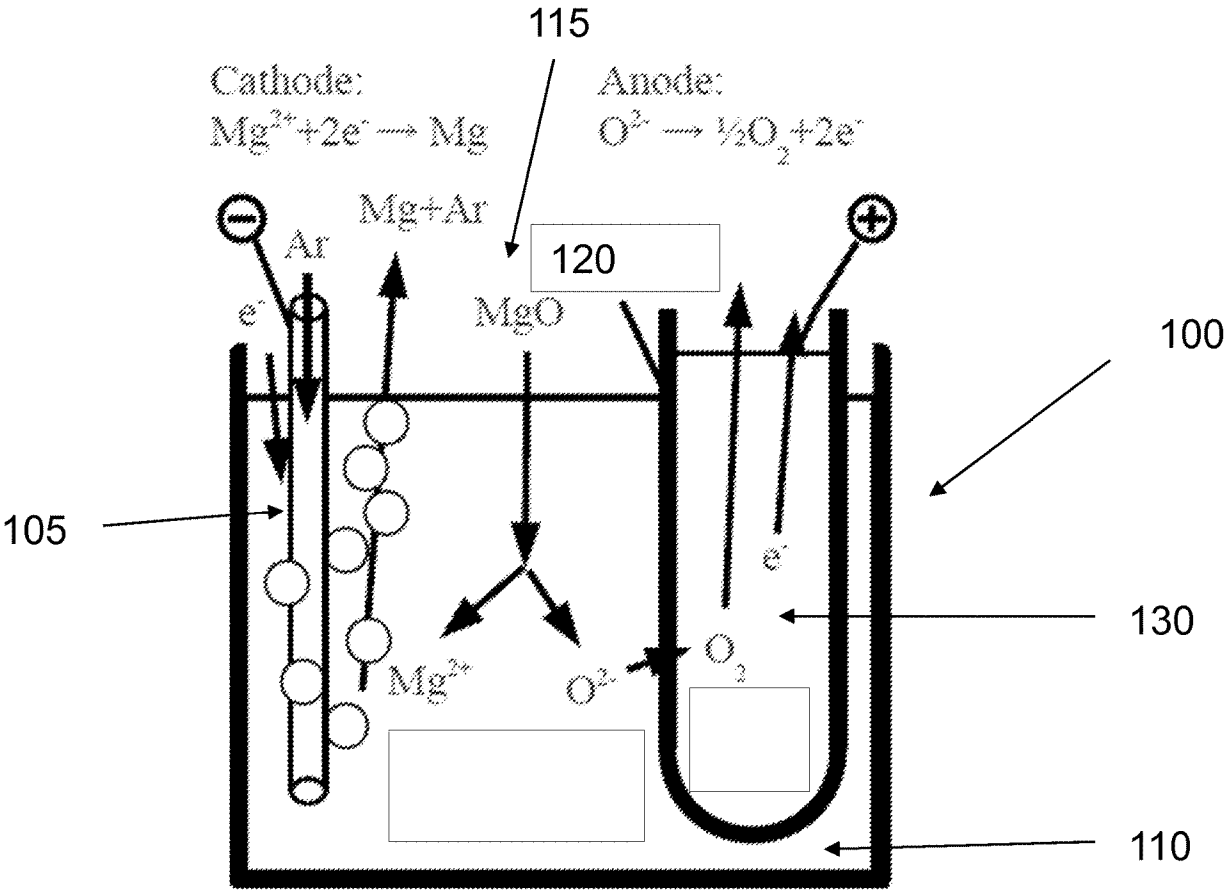
FIG. 1. A schematic illustration of a SOM process.

Development of the solid oxide membrane (SOM) electrolysis process has provided an alternative method for refinement of metal oxides (see, e.g, U.S. Pat. Nos. 5,976,345, and 6,299,742; each herein incorporated by reference in its entirety). The process as applied to metal production is shown in FIG. 1. The apparatus 100 consists of a metal cathode 105, a molten salt electrolyte bath 110 that dissolves the metal oxide that is in electrical contact with the cathode, a solid electrolyte oxygen ion conducting membrane (SOM) 120 typically consisting of zirconia stabilized by yttria (YSZ) or other low valence oxide-stabilized zirconia, for example, magnesia- or calcia-stabilized zirconia (MSZ or CSZ, respectively) in ion-conducting contact with the molten salt bath 110, an liquid anode 130 in ion-conducting contact with the solid oxygen ion-conducting membrane, and a power source for establishing a potential between the cathode and anode. The power source can be any of the power sources suitable for use with SOM electrolysis processes and are known in the art. The potential can include, but is not limited to, applying a voltage. In some embodiments, the potential is established by applying a voltage or a establishing a chemical potential. In some embodiments, the potential is established by applying a voltage. In some embodiments, the potential is established by establishing a chemical potential. In some embodiments, establishing a chemical potential providing a fuel at the first electrode and providing an oxidizing gas at the second surface of the displacing material.

The metal cations are reduced to metal at the cathode, and oxygen ions migrate through the membrane to the anode where they are oxidized to produce oxygen gas. The SOM blocks back-reaction between anode and cathode products. It also blocks ion cycling, which is the tendency for subvalent cations to be re-oxidized at the anode, by removing the connection between the anode and the metal ion containing molten salt because the SOM conducts only oxide ions, not electrons (see, U.S. Pat. Nos. 5,976,345, and 6,299,742; each herein incorporated by reference in its entirety); however the process runs at high temperatures, typically 1000-1300° C. in order to maintain high ionic conductivity of the SOM. The anode must have good electrical conductivity at the process temperature while exposed to pure oxygen gas at approximately 1 atm pressures.

Liquid metals, such as silver, are used to achieve a current in oxygen producing electrodes, such as anodes, while maintaining robust ionic contact with the SOM. However, oxygen transport and removal remain problematic. Where current is high and a small cross section of silver is present, rapidly evolving oxygen gas causes silver to splash out of the electrode. If an electrolysis device with a silver anode runs well above the melting point of silver (about 1150° C.), the high silver vapor pressure results in considerable silver evaporation. The silver will be approximately at its vapor pressure in the oxygen stream. This can result in rapid silver loss from the anode, resulting in increased cost of a metal production process. Much of the silver can condense in the exit tube. If the exit tube is configured upward and the silver condenses in the liquid state, it can flow downward and return to the electrode, which will dramatically reduce the loss of silver. However, using a dense oxygen transport membrane such as a mixed ionic/electronic conductor (MIEC) or pores filled with oxygen-diffusing liquid remediates the problem by minimizing and/or preventing silver from evaporation and entering the oxygen stream. Herein, novel electrode configurations that allow oxygen to permeate a material are provided.

Some embodiments of the invention relate to oxygen-generating anodes for electrolysis of oxides including metal oxides and water, for creating a low-oxygen environment for metal refining, and for fuel cells. Oxygen stable liquid metals are used, such as silver and alloys thereof, for the anode where charge transfer takes place. However, the volume and/or evaporation rate of such metals can be minimized in order to reduce system capital cost. In some embodiments, such anodes efficiently oxidize oxygen ions and transport the resultant oxygen atoms through the liquid metal to the interface between the metal and displacing material to form oxygen gas. In some embodiments where the displacing material is a MIEC membrane, such anodes efficiently oxidize oxygen ions and transport the resultant oxygen atoms through the liquid metal to the interface between the metal and MIEC; at that interface, the oxygen atoms pick up electrons from the electronic conducting phase of the membrane, the resulting oxygen ions migrate through the oxygen ion conducting phase of the membrane, and the oxygen ions are re-oxidized at the MIEC-gas interface, releasing their electrons to the electronic phase of the membrane, and becoming oxygen atoms and/or oxygen gas molecules.

Alternative embodiments use a liquid metal that is not stable in oxygen, illustratively copper, tin, bismuth, antimony or alloys thereof, and expose a fuel source, illustratively methane, hydrocarbon, hydrogen, CO or carbon to the liquid metal. In some embodiments, exposure of the fuel source to the liquid metal reduces oxygen activity and/or stabilizes the liquid metal. Porous embodiments of oxygen facilitators in contact with tin anodes are shown, for example, in U.S. Pat. No. 7,745,064 (herein incorporated by reference in its entirety) which uses porous ceramic oxide materials to separate the liquid metal from fuel. This invention expands on '064 in two ways: it broadens the applications to include separation of oxygen from other gases, gaseous compounds such as steam or $CO_2$, or metal oxides; and it broadens the available materials to include MIECs and other oxygen diffuser materials. The use of MIECs and other oxygen diffuser materials can reduce the performance of a fuel cell considerably by decreasing output voltage by 0.2-0.7 volt or more, out of a maximum open circuit voltage of 1-1.5 volts. In contrast, electrolysis cells which separate oxygen often operate by external application of 2-6 volts, or even 25 volts for some rare earth metal cells, such that 0.2-0.7 volts of losses are relatively minor.

Figure 2:
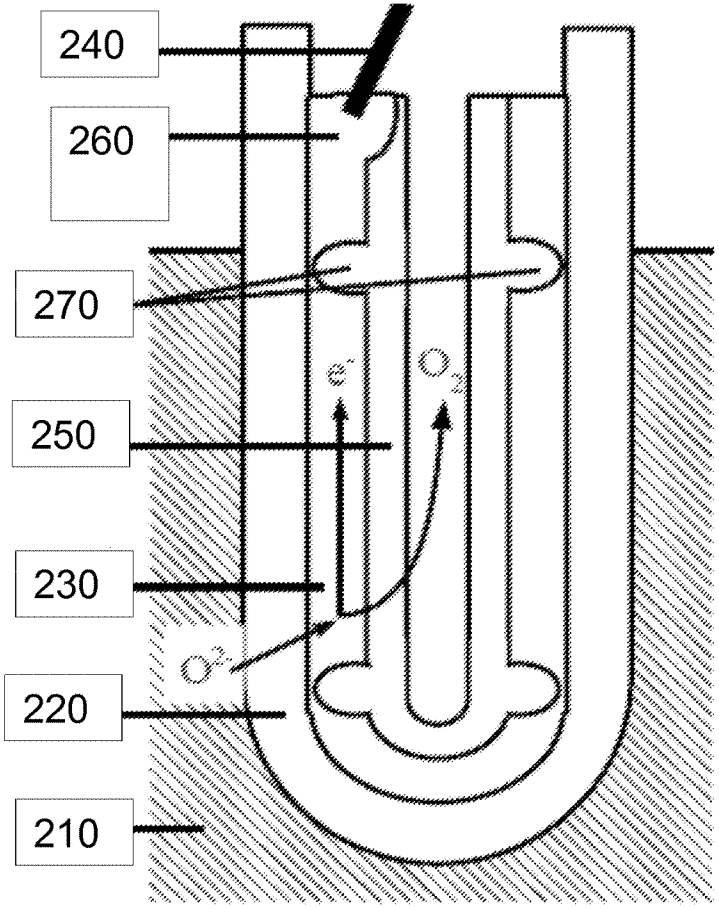
FIG. 2. An illustrative embodiment of a liquid metal anode configuration and a material for displacing the liquid according to an embodiment of the invention.

A schematic embodiment is shown in FIG. 2. A liquid metal anode 230 is in contact with: a solid oxygen ion-conducting electrolyte (220); a current collector (240) that conducts electrons; and a material for displacing the liquid metal (250) with pores or other means of gas transport from the liquid metal to the gas phase. Oxygen ions migrate from the molten salt (210) through the solid electrolyte (220) to the liquid metal anode (230), where they form dissolved oxygen atoms and free electrons. The oxygen atoms diffuse through the liquid metal anode then cross the displacing material (250) to the gas phase where they form oxygen gas which flows away from the anode. The electrons travel to the current collector (240). Note that in order to illustrate certain features, the figures are not to scale. In some embodiments, the solid electrolyte thickness is between about 50 μm and about 4 mm and preferably between about 1 mm and about 3 mm, the liquid metal anode thickness is between about 50 μm and about 5 mm and preferably between about 100 μm and about 1 mm, and the displacing material thickness is between about 1 mm and about 10 mm.

The displacing material serves several advantageous purposes. In some embodiments, it displaces the liquid metal, reducing its volume, and thus reducing its cost. In some embodiments, it minimizes or prevents the liquid metal from passing through it. By reducing the thickness of the liquid metal, in some embodiments it enables oxygen removal by diffusion alone, minimizing or eliminating bubbling and the resulting splashing of liquid metal against the solid electrolyte tube. In some embodiments, it reduces the interfacial area between the liquid metal and gas, which can reduce liquid metal evaporation rate, which in turn reduces operating cost. Exemplary porous displacing materials are described in U.S. Pat. No. 7,943,270 and U.S. Patent Publication No. 2009-0166214 (each herein incorporated by reference in its entirety).

The apparatuses and methods described herein are not limited to metal reduction, but in some embodiments are useful for splitting steam to produce hydrogen, for reducing other oxides in the gas or liquid phase, for creating a chemically low-oxygen (reducing) environment, and/or for producing pure oxygen gas from various oxides, gases, or gas mixtures. Exemplary methods of hydrogen production to which the apparatus and methods herein are applicable are described in U.S. Pat. No. 5,567,286; U.S. Pat. No. 8,658,007; and U.S. Patent Publication No. 2013-0026032 (each herein incorporated by reference in its entirety). For example, U.S. Pat. No. 5,567,286 describes adding oxygen to or removing it from a liquid metal, adding oxygen to remove carbon from steel, and removing oxygen from copper to produce oxygen-free high-conductivity copper. Liquid metal anodes and electrochemical devices that are also useful are described, for example, in U.S. Patent Publication No. 2013-0143139 (herein incorporated by reference in its entirety).

It will also be recognized that various components in some embodiments are optional such as, for example, a cathode, a current collector, and/or a power supply. Thus, in some embodiments, the apparatus and/or method comprises the anode and displacing material.

In another embodiment, an air-side cathode for a solid oxide fuel cell (SOFC) is provided comprising a material for displacing liquid metal. In some embodiments, the air-side cathode comprises liquid silver and a current collector such as in, for example, U.S. Patent Publication No. 2013-0192998 (herein incorporated by reference in its entirety). In an exemplary embodiment, the cathode comprises an oxygen transport membrane such as a porous oxide or mixed ionic/electronic conductor. In some embodiments, the current collector comprises a rod of nickel or Inconel or similar alloy in an alumina sheath, with strontium-doped lanthanum manganite (LSM) connecting the liquid silver anode to the inner metal rod. This and similar embodiments are described in U.S. Patent Publication No. 2013-0192998 and U.S. Pat. No. 3,138,490 (each herein incorporated by reference in its entirety).

Other applications will be evident to those of ordinary skill in the art.

In some embodiments, a reservoir of liquid anode metal (260) is connected to the main body of liquid metal in order to replace any metal lost to evaporation, as shown in FIG. 2. If the anode is very thin and the displacing material is thick, then simply creating a well by removal of some of the displacing material, as shown in FIG. 2 can create a suitable reservoir for this purpose. This reservoir of liquid metal can also be an electrical contact point for a current collector, such as that described by U.S. patent application Ser. No. 13/600,761, published as U.S. Patent Publication No. 2013-0192998 (herein incorporated by reference in its entirety).

In some embodiments, the displacing solid can include protrusions (270) on its surface, such as ridges or bumps, qualitatively similar to those in FIG. 2. In some embodiments, protrusions keep the displacing solid centered. In some embodiments, protrusions prevent the liquid anode from being too lopsided. If the anode is lopsided, this can increase the resistance of parts of the cell, leading to non-uniform current density. If the protrusions are very wide, they can locally reduce the current through the solid electrolyte, promoting localized thermal gradients which could result in fracture or other damage of the solid electrolyte. It is advantageous that the minimum and maximum anode thicknesses (away from the protrusions) are within about a factor of three; and particularly advantageous that they are within 30%. In some embodiments, the protrusions displace a liquid anode region near the solid electrolyte that is no more than about 3 mm across. It is particularly advantageous that the protrusions displace a liquid anode region near the solid electrolyte that is no more than about 1 mm across.

In some embodiments, the displacing material thickness is between about 1 mm and about 10 mm. In some embodiments, the displacing material thickness is between about 1 mm and about 7 mm. In some embodiments, the displacing material thickness is between about 1 mm and about 5 mm. In some embodiments, the displacing material thickness is between about 1 mm and about 3 mm. In some embodiments, the displacing material thickness is between about 1 mm and about 2 mm.

Instead of producing oxygen, in some embodiments a fuel is injected into the gas region inside the displacing material. The fuel is illustratively syngas, methane, hydrogen, CO, or other hydrocarbons. In some embodiments, the fuel comprises syngas. In some embodiments, the fuel comprises hydrocarbon, hydrogen or CO. In some embodiments, the fuel comprises hydrocarbon or hydrogen. In some embodiments, the fuel comprises hydrogen or CO. In some embodiments, the fuel comprises hydrocarbon. In some embodiments, the hydrocarbon comprises methane. In some embodiments, the fuel comprises hydrogen. In some embodiments, the fuel comprises CO. In some embodiments, the fuel diffuses through the displacing material to the anode surface, where oxygen ions would oxidize the fuel to form water and CO and/or $CO_2$ reaction products, which diffuse and flow away from the anode. In some embodiments, fuel at the anode lowers the oxygen activity in the anode material, creating a driving force for oxygen removal from the molten salt, which would either increase the reaction rate and current density or reduce the voltage required to achieve the same current density with oxygen production.

Figure 3:
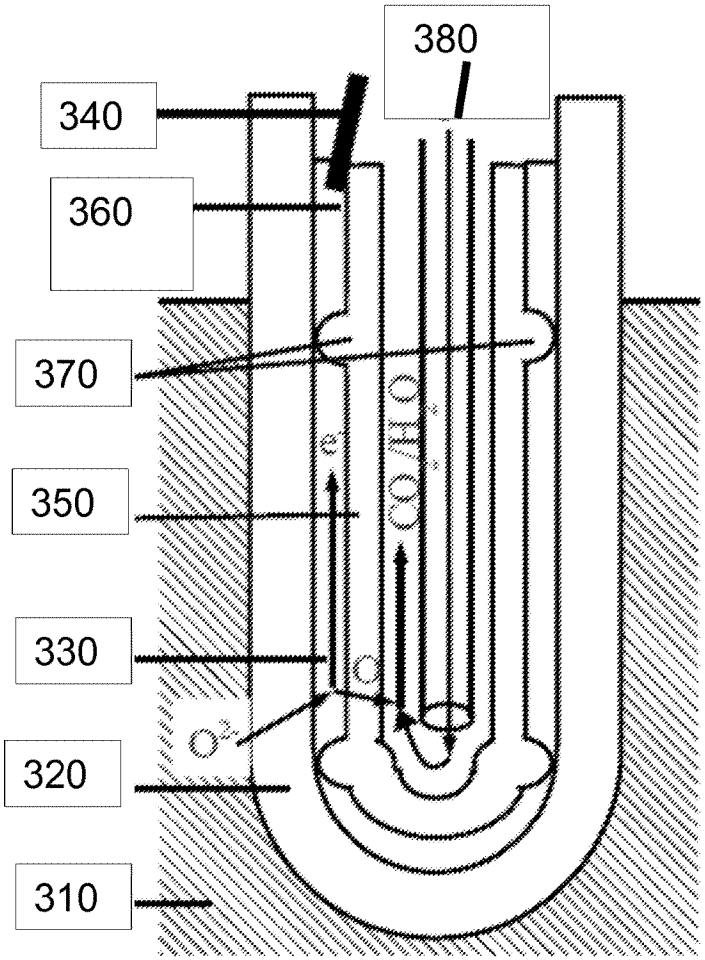
FIG. 3. An illustrative embodiment showing a fuel delivery tube inside the displacing solid according to an embodiment of the invention.

In some embodiments, a gaseous fuel is injected via a fuel tube (380), illustratively methane, syngas, hydrogen, or other hydrocarbons, into the space inside the displacing solid (350), an exemplary embodiment of which is shown in FIG. 3. The fuel delivery tube disposed inside the displacing solid and combustion products from reaction with oxygen are shown. In these embodiments, the fuel rapidly reacts with oxygen coming through the displacing solid (350), which lowers oxygen activity considerably. With sufficiently effective oxygen transport through the displacing solid, oxygen activity is low enough to allow the use of inexpensive liquid metals for the anode (330), including but not limited to tin, copper, bismuth, antimony, lead, silver, or alloys containing one or more of these metals. The molten salt (310) and solid oxygen ion-conducting electrolyte (320) are also shown. In some embodiments, the fuel tube comprises a conductive metal, such as nickel or cobalt, and can be attached to, and form part of, the current collector (340). Optional embodiments include liquid metal reservoir (360) and protrusions (370). In some embodiments, the fuel delivery tube is a stable oxide, such as aluminum oxide, mullite, or magnesium oxide, such that it is stable in both oxygen and fuel gas, and the device can operate in either oxygen production or fueled modes depending on the flow rate of fuel.

Figure 4:
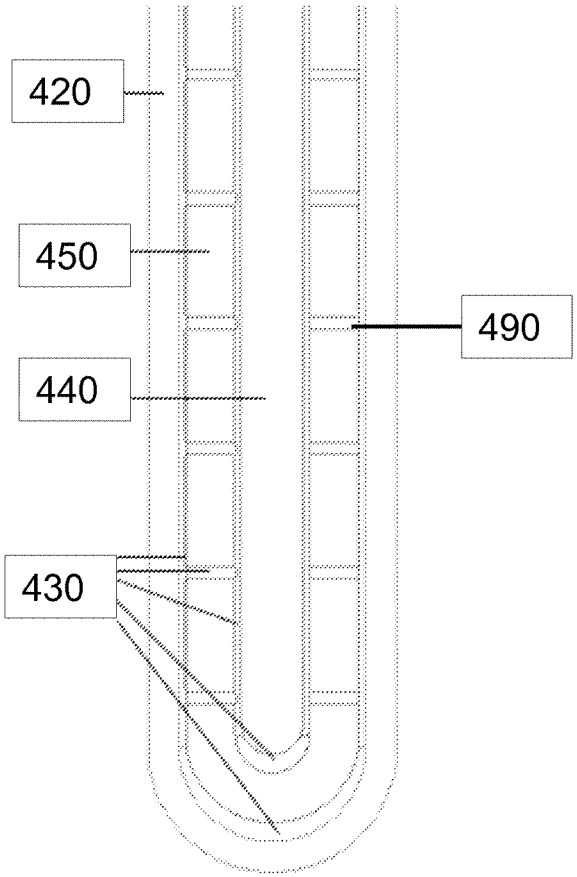
FIG. 4. An illustrative embodiment showing conduits through the displacing solid according to an embodiment of the invention.

In some embodiments, conduits (490) are introduced through the displacing solid (450) for the liquid metal (430) to contact both the outer solid electrolyte (420) and the inner current collector (440), as shown in FIG. 4. The cross-sectional view shows conduits through the displacing solid for liquid metal continuity between the outer solid electrolyte contact region and the inner current collector. In some embodiments, conduits enhance electronic conduction from the solid electrolyte to the current collector. In some embodiments, the displacing solid serves as the primary vertical conduit of oxygen gas or combustion products upward through the assembly. The optimal liquid metal/displacing solid combination geometry will depend on the conductivity of the liquid metal and current collector, and gas permeability of the displacing solid.

It is particularly advantageous that the liquid metal occupy the space between the solid oxygen ion-conducting electrolyte and displacing material, but not enter the displacing material. There are several approaches to achieving such a configuration.

In some embodiments, the displacing material comprises a porous solid whose pores are much smaller than the thickness of the metal film between the solid electrolyte and displacing material, as nominal operating pressure ranges around 1 atm can keep the liquid metal in the electrolyte-displacing material gap while not forcing it into the small pores of the displacing material.

In some embodiments, wetting behavior assists this constraint: the liquid metal wets the surface of the solid electrolyte better than it wets the interior of the pores in the displacing porous solid, such that the silver preferentially stays in the electrolyte-displacing material gap and preferentially does not substantially enter the displacing material pores.

In some embodiments, the displacing material comprises a dense solid. The dense solid preferentially allows the diffusion or migration of oxygen atoms or molecules from the liquid metal anode to the gas, or fuel from the gas to the liquid anode and reaction products back to the gas, but prevents the metal from passing through. For example, a mixed ionic-electronic conducting membrane (MIEC), such as that of Gopalan et al. (U.S. Pat. No. 7,588,626; herein incorporated by reference in its entirety) is advantageous by allowing oxide ions to travel through the ionic conducting component and returning electrons to the anode. In such material systems, flux is often proportional to the log of the ratio of oxygen activities, making them particularly suitable to a fueled system like that of FIG. 3, as the presence of fuel decreases oxygen activity by orders of magnitude. Other exemplary MIECs are described in U.S. Pat. Nos. 5,562,754; 5,837,125; 6,623,714; and 7,118,612 (each herein incorporated by reference in its entirety).

In some embodiments, the displacing material comprises a two-phase liquid-solid material that allows the oxygen, or fuel and reaction products, to diffuse or migrate between the liquid metal anode and gas phase, but whose liquid is immiscible with the liquid metal anode and blocks its vapor from passing to the gas phase. The liquid can illustratively be lead oxide, tellurium oxide, or bismuth oxide. In some embodiments, the liquid comprises lead oxide, tellurium oxide, or bismuth oxide. In some embodiments, the liquid comprises lead oxide or tellurium oxide. In some embodiments, the liquid comprises lead oxide or bismuth oxide. In some embodiments, the liquid comprises tellurium oxide or bismuth oxide. In some embodiments, the liquid comprises lead oxide. In some embodiments, the liquid comprises tellurium oxide. In some embodiments, the liquid comprises bismuth oxide.

In some embodiments, the displacing material and/or solid electrolyte includes surface protrusions which maintain a minimum distance throughout most of the electrolyte-displacing solid gap. An exemplary type of such embodiments is shown in FIG. 2.

In some embodiments, the oxygen forms bubbles in the liquid metal anode that move to the gas-metal interface in order to transport oxygen to the gas.

In some embodiments, features in the displacing material, such as grooves or a second oxide phase with different liquid metal wettability, cause the gas phase to connect to the anode and solid electrolyte, such that there is an electrolyte-anode-gas triple line where the oxygen ions from the solid electrolyte can give up their electrons to the anode and become oxygen gas. In such embodiments, the oxygen neither has to diffuse through the liquid metal, nor nucleate and grow an oxygen bubble, so the reaction kinetics at the triple line can be very fast. By its nature a triple line is one-dimensional, resulting in a small and concentrated reaction region relative to a two-dimensional surface.

In some embodiments, surface features on the solid electrolyte, illustratively grooves or a second oxide phase with different liquid metal wettability, promote formation of an attached bubble nucleus that creates oxygen bubbles that may float through the liquid metal electrode. Alternatively, those same surface features can promote the stability of a gas phase attachment to the solid electrolyte. In some embodiments, surface features create engineered patterns of bubble nuclei or gas phase attachments that lead to high solid electrolyte-anode-gas triple line length per unit area.

In some embodiments, the displacing solid comprises a surface which the anode metal wets well, and a volume where condensed anode metal vapor can collect as a liquid and/or solid without interfering with gas, e.g. oxygen, flow. Such embodiments may enhance the recovery of the evaporated and condensed liquid metal. In some embodiments, conditions are provided for heterogeneous nucleation of second electrode, e.g. anode, metal liquid and/or solid condensate on a surface, such as a steel tube, such that the condensed anode metal can be re-melted or mechanically pushed out. In some embodiments, this second electrode metal liquid or solid condensate can feed the liquid second electrode metal reservoir described herein.

In some embodiments, the second electrode assembly structure is manufactured by placing a tube made from a thin sheet of the anode metal inside of a tubular solid electrolyte, and then inserting the displacing solid tube inside the metal sheet.

In some embodiments, the second electrode, e.g. anode, metal is placed in a mold, illustratively made of graphite, with geometry complementary to that of the zirconia electrolyte, heated to melt the metal, then displaced by inserting the displacing material, and cooled to solidify at least a portion of the metal. The metal electrode-displacing material assembly can be withdrawn and attached or inserted to the solid electrolyte.

In some embodiments, the second electrode, e.g. anode, metal is melted in the solid electrolyte in the cell, and the displacing solid inserted into the liquid second electrode, e.g. anode, metal, producing an electrolyte-anode-displacing solid assembly ready for use.

In some embodiments, the solid second electrode, e.g. anode, metal is inserted as a dense block or rod into the solid electrolyte, the displacing solid is inserted, the current collector is inserted, and the entire assembly together is heated, thus melting the second electrode, e.g. anode, metal. This permits the displacing solid and current collector to descend into and displace the melted (liquid) second electrode, e.g. anode, metal, creating the exemplary embodiments shown in FIG. 2, 3 or 4.

In some embodiments, the liquid metal comprises silver or gold, a combination of silver and gold, or their alloys with electronegative metals such as copper, tin, lead, bismuth, or combinations of these alloying elements, or any other liquid metal stable in oxygen at the operating conditions of the second electrode. When used with a fuel, then silver or gold is not necessary. In some embodiments, the liquid metal comprises silver or gold, a combination of silver and gold, or their alloys with electronegative metals such as copper, tin, lead, bismuth, or combinations of these alloying elements. In some embodiments, the liquid metal comprises silver or gold, a combination of silver and gold, or their alloys with copper, tin, lead, bismuth, or combinations of these alloying elements. In some embodiments, the liquid metal comprises silver or silver alloys with copper, tin, lead, or bismuth. In some embodiments, the liquid metal comprises gold or gold alloys with copper, tin, lead, or bismuth. In some embodiments, the liquid metal comprises silver. In some embodiments, the liquid metal comprises silver alloys with copper, tin, lead, or bismuth. In some embodiments, the liquid metal comprises gold. In some embodiments, the liquid metal comprises gold alloys with copper, tin, lead, or bismuth.

In some embodiments, the liquid metal thickness is between about 50 μm and about 5 mm. In some embodiments, the liquid metal thickness is between about 50 μm and about 3 mm. In some embodiments, the liquid metal thickness is between about 100 μm and about 3 mm. In some embodiments, the liquid metal thickness is between about 200 μm and about 3 mm. In some embodiments, the liquid metal thickness is between about 50 μm and about 2 mm. In some embodiments, the liquid metal thickness is between about 100 μm and about 2 mm. In some embodiments, the liquid metal thickness is between about 200 μm and about 2 mm. In some embodiments, the liquid metal thickness is between about 50 μm and about 1 mm. In some embodiments, the liquid metal thickness is between about 100 μm and about 1 mm. In some embodiments, the liquid metal thickness is between about 200 μm and about 1 mm.

In some embodiments, the solid electrolyte comprises zirconia doped with yttria, calcia, magnesia, scandia, dysprosia, or other additives that stabilize its cubic phase and enhance its conductivity; or ceria doped with oxides to increase its ion, e.g oxygen, conductivity; or any other oxygen ion-conducting solid electrolyte. In some embodiments, it is a conductor of other anions, such as sulfide, chloride and/or fluoride ions, possibly in addition to oxide ions, in which case the anode would produce sulfur, chlorine or fluorine, and possibly oxygen gas. In some embodiments, the solid electrolyte comprises zirconia doped with yttria, calcia, magnesia, scandia, or dysprosia; or ceria doped with oxides to increase its oxygen ion conductivity. In some embodiments, the solid electrolyte comprises zirconia doped with yttria, calcia, magnesia, scandia, or dysprosia. In some embodiments, the solid electrolyte comprises zirconia doped with yttria, calcia, magnesia, or scandia. In some embodiments, the solid electrolyte comprises ceria doped with oxides. In some embodiments, the solid electrolyte comprises a conductor of other anions, such as sulfide, chloride and/or fluoride ions, possibly in addition to oxide ions. In some embodiments, the solid electrolyte comprises a conductor of sulfide, chloride or fluoride ions. In some embodiments, the solid electrolyte comprises a conductor of sulfide ions. In some embodiments, the solid electrolyte comprises a conductor of chloride ions. In some embodiments, the solid electrolyte comprises a conductor of fluoride ions.

In some embodiments, the solid electrolyte thickness is between about 50 μm and about 4 mm. In some embodiments, the solid electrolyte thickness is between about 50 μm and about 3 mm. In some embodiments, the solid electrolyte thickness is between about 500 μm and about 4 mm. In some embodiments, the solid electrolyte thickness is between about 500 μm and about 3 mm. In some embodiments, the solid electrolyte thickness is between about 1 mm and about 4 mm. In some embodiments, the solid electrolyte thickness is between about 1 mm and about 3 mm.

In some embodiments, the displacing material comprises a porous oxide such as alumina, zirconia, magnesia, ceria, or titania, or aluminum titanate or aluminum zirconate, or a porous oxide which is at least 50% by mole of one of those, whose surface wets the liquid metal second electrode, but whose pores do not appreciably wet the liquid metal second electrode, e.g. where the liquid metal second electrodecontact angle on the surface is below about 90°, but in the pores is above about 90°. In some embodiments, the displacing material comprises alumina, zirconia, magnesia, ceria, or titania, or aluminum titanate or aluminum zirconate. In some embodiments, the displacing material comprises alumina, zirconia, magnesia, ceria, or titania. In some embodiments, the displacing material comprises aluminum titanate or aluminum zirconate. In some embodiments, the displacing material comprises a porous oxide which is at least about 50% by mole alumina, zirconia, magnesia, ceria, or titania, or aluminum titanate or aluminum zirconate. In some embodiments, the displacing material comprises a porous oxide whose surface wets the liquid metal second electrode, but whose pores do not appreciably wet the liquid metal second electrode, e.g. where the liquid metal second electrodecontact angle on the surface is below about 90°, but in the pores is above about 90°. In some embodiments, the displacing material comprises a porous material supporting in its pores a liquid metal or oxide which is immiscible with silver, such as lead oxide or bismuth oxide. In some embodiments, the displacing material comprises an oxygen transport membrane such as, for example, a mixed ionic/electronic conductor, such as that of Gopalan et al. (U.S. Pat. No. 7,588,626; herein incorporated by reference in its entirety).

In some embodiments, the current collector component which connects to the second electrode, such as that described by Powell et al. (U.S. Patent Publication No. 2013-0192998; herein incorporated by reference in its entirety) can be made of strontium-doped lanthanum manganate with illustrative composition $La_{0.8}Sr_{0.2}MnO_3$, or other ferrites, chromites, cobaltites, or related perovskites. In some embodiments, the current collector comprises an electronically conducting oxide, such as doped zinc oxide, tin oxide, or other conducting oxide material. In some embodiments, the current collector comprises titanium diboride, iridium, palladium, or platinum, or a metal such as nickel or titanium with a coating of iridium or platinum. In some embodiments, the current collector comprises stainless steel, particularly one with conducting scale, such as those used as solid oxide fuel cell (SOFC) contacts. Other exemplary current collector components and configurations are described in U.S. Patent Publication No. 2013-0192998; herein incorporated by reference in its entirety.

Additional embodiments can comprise spacers, such as for example bumps, ridges, rings, or spirals. In some embodiments, the spacers maintain a uniform thickness of the liquid metal anode between the solid electrolyte and displacing solid. In some embodiments, the spacers protrude from the electrolyte, protrude from the solid, or exist as separate solids. Preferably the spacer geometry interferes as little as possible with the conduction of electrons and diffusion of gas, e.g. oxygen, atoms through the liquid metal second electrode.

Additional embodiments can comprise a reservoir of liquid metal, such as that shown illustratively in FIG. 2, which can replenish the second electrode between the solid electrolyte and displacing solid, such that if the second electrode is very thin, evaporation does not appreciably reduce the electrolyte-second electrode contact area or the second electrode gas interface area.

Additional embodiments can comprise a combined liquid metal contact/reservoir and gas diverter, which forms a conduit from the outer liquid metal second electrode film to a current collector more in the center of the assembly. In some embodiments, the diverter can also divert the gas around this contact, such that the gas-metal interface area is minimal, in order to minimize evaporation rate of metals such as silver, bismuth, etc.

In some embodiments, the configuration can be switched between fueled and oxygen-generating operation by changing out the current collector. The device would switch between an electrode assembly configuration with current collector and a fueled anode assembly with a metal current collector and fuel tube. In some embodiments, the complex current collector assembly is used with a fueled anode. Such embodiments enable switching between fueled and oxygen producing modes simply by injecting or not injecting fuel without changing the current collector assembly. It is advantageous in such embodiments to obtain near complete combustion to carbon dioxide/water in order to minimize reduction of the LSM surface. In some embodiments, the anode can be switched between an oxygen-generating anode and a fueled anode where natural gas is the fuel.

In some embodiments, the methods or apparatus further comprise one or more current collectors in electrical contact with the liquid metal second electrode, the one or more current collectors conveying the electrical potential to the liquid metal second electrode, and the one or more current collectors comprising a material that maintains its electrical conductivity in a reducing environment.

In some embodiments, the fuel inlet is comprised of materials stable in the reducing environment but not electrically conducting, such as non-oxide ceramics (e.g. boron nitride). The fuel inlet need not contact the liquid metal second electrode in order to inject fuel, for example it can create a fuel jet which reacts with oxygen from the liquid metal second electrode.

While some embodiments of the invention can use pure hydrogen as a fuel, other embodiments of the invention use syngas (a mixture of hydrogen and CO), natural gas, a mixture of natural gas and steam, and/or other gaseous carbon fuels such as carbon monoxide.

It will be recognized that one or more features of any embodiments disclosed herein may be combined and/or rearranged within the scope of the invention to produce further embodiments that are also within the scope of the invention.

Those skilled in the art will recognize, or be able to ascertain using no more than routine experimentation, many equivalents to the specific embodiments of the invention described herein. Such equivalents are also intended to be within the scope of the present invention.

EXAMPLES

The examples provided below facilitate a more complete understanding of the invention. The following examples illustrate exemplary modes of making and practicing the invention. However, the scope of the invention is not limited to specific embodiments disclosed in such examples, which are illustrative only, since alternative methods can be utilized to obtain similar results.

In an exemplary mode, the anode is liquid silver, the solid oxygen ion-conducting electrolyte is zirconia stabilized by yttria and/or other metal oxides, and the displacing material is porous alumina. The goals are to minimize the amount of silver in the anode, and to minimize the total overpotential in the anode-gas system in order to minimize energy usage and costs.

In a large tube, the silver film extends 40 cm upward from the bottom of the closed end of the zirconia tube, which has 2.5 cm inner diameter and approximately 8 cm circumference, and the silver film is approximately 0.5 mm thick. The silver film mass is approximately 80 g.

Electronic Conduction

Liquid silver has a very high electrical conductivity of approximately $6\times10^4$ S/cm at its melting point at 962° C.

which decreases to $5\times10^4$ S/cm at 1180° C. (*J. Alloys Compounds* 1998, 274:148-152; herein incorporated by reference in its entirety). This means that a liquid silver anode with the above dimensions has a resistance in the lengthwise direction of just $2\times10^{-3}\Omega$ at 1180° C., and $1.7\times10^{-3}\Omega$ at 962° C.

With current density at 1 A/cm$^2$ coming through the inner zirconia surface, this would lead to total current of 300 A. The average overpotential due to silver resistance would be about 0.3 V at 1180° C., 0.25 V at 962° C., which is not high for this application. For this reason, the current collector need not have intimate or repeated contact over the film, but need only contact the liquid silver film in one or two places, such as the liquid silver reservoir atop the film mentioned in some embodiments above and shown in FIG. 2.

A thinner silver layer would exhibit higher resistance and overpotential, increasing the required total voltage and the energy cost. It would also likely lead to less uniform current density distribution, as there would be higher resistance to electron conduction from the bottom of the tube, and therefore lower current density there.

Oxygen Diffusion

Oxygen solubility in silver at 1 atm is 0.3 wt %, 2.09 mol %, 30 mg/cm$^3$. So direct diffusion-evaporation may be feasible for a silver layer as thick as 0.5-1 mm. If the gas phase surface is at Cg=30 mg/cm$^3$, then at 1 A/cm$^2$ with oxygen atom flux of $5\times10^{-6}$ mol/cm$^2$-sec=$8\times10^{-5}$ g/cm$^2$-sec through a 0.55 mm silver film, this would put the zirconia surface at Cz=30 mg/cm$^3$+ΔC where:

$$J=D\Delta C/L, \text{ so}$$

$$\Delta C=LJ/D=0.05\ \text{cm}\times 8e\text{-}5\ \text{g/cm}^2\text{-sec}/1e\text{-}4\ \text{cm}^2/\text{sec}=0.04\ \text{g/cm}^3$$

About 40 mg/cm$^3$, so the total oxygen concentration at the zirconia-silver interface would be 70 mg/cm$^3$ and equilibrium vapor pressure would be about 2.3 atm. That is likely not sufficient to nucleate a bubble, particularly in such a confined space as a 0.5 mm gap.

An equilibrium pressure of 2.3 atm ($2.3\times10^5$ J/m$^3$), which at 962° C. leads to a gas density of 27 mol/m$^3$, corresponds to an energy of 8.6 kJ/mol. With four electrons transferred per mole of oxygen molecules, this corresponds to an overpotential of 0.022 V due to the resistance to diffusion of oxygen through the silver film, which is insignificant.

Note that the oxygen gradient can provide an advantage when the displacing solid is a porous oxide. Many metals wet oxides considerably better when oxygen concentration is high than when it is low (*Mater. Sci. Eng.* 2001, A300: 34-40; herein incorporated by reference in its entirety). In this case, oxygen concentration is highest next to the solid electrolyte, where good wetting is important to maintain electrical contact and to maintain the liquid metal film coverage throughout the entire gap. And oxygen concentration is lowest next to the displacing solid, where poor wetting prevents the silver from entering the pores of the oxide.

As will be apparent to one of ordinary skill in the art from a reading of this disclosure, further embodiments of the present invention can be presented in forms other than those specifically disclosed above. The particular embodiments described above are, therefore, to be considered as illustrative and not restrictive. Those skilled in the art will recognize, or be able to ascertain, using no more than routine experimentation, numerous equivalents to the specific embodiments described herein. Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways within the scope and spirit of the invention. The scope of the invention is as set forth in the appended claims and equivalents thereof, rather than being limited to the examples contained in the foregoing description.

What is claimed is:

1. An apparatus comprising:

(a) a cathode in ion-conducting contact with a molten electrolyte;

(b) a solid oxygen ion-conducting electrolyte in ion-conducting contact with the molten electrolyte;

(c) a liquid metal anode disposed within the solid oxygen ion-conducting electrolyte;

(d) a displacing material comprising a first surface in contact with the liquid metal anode and a second surface exposed to an environment outside of the liquid metal anode, wherein the displacing material comprises a two-phase liquid solid and said material permits flow of gas and impedes the flow of liquid metal; and (e) a power supply for establishing a potential between the cathode and the anode.

2. The apparatus of claim 1, wherein the first surface of the displacing material comprises protrusions.

3. The apparatus of claim 2, wherein the protrusions displace at least a portion of the liquid anode.

4. The apparatus of claim 2, wherein the protrusions comprise bumps, ridges, rings or spirals.

5. The apparatus of claim 1, wherein the displacing material comprises a plurality of displacing solids.

6. The apparatus of claim 1, wherein conduits are present through the displacing material.

7. The apparatus of claim 1, wherein the displacing material comprises a porous oxide or an oxygen transport membrane.

8. The apparatus of claim 7, wherein the oxygen transport membrane comprises a mixed ionic-electronic conductor.

9. The apparatus of claim 7, wherein the porous oxide comprises alumina, zirconia, magnesia, ceria, titania, aluminum titanate or aluminum zirconate.

10. The apparatus of claim 7, wherein the liquid metal does not enter the pores of the displacing material.

11. The apparatus of claim 1, wherein the liquid metal wets the surface of the solid electrolyte.

12. The apparatus of claim 1, wherein the liquid phase is immiscible with the liquid metal anode.

13. The apparatus of claim 1, wherein the liquid phase comprises lead oxide, tellurium oxide or bismuth oxide.

14. The apparatus of claim 1, wherein the liquid metal is oxygen stable.

15. The apparatus of claim 1, wherein the liquid metal anode comprises silver, gold, or alloys thereof.

16. The apparatus of claim 15, wherein the liquid metal anode alloy further comprises copper, tin, lead, or bismuth.

17. The apparatus of claim 1, wherein the liquid metal anode comprises silver.

* * * * *